US006540001B1

(12) United States Patent
McNestry

(10) Patent No.: US 6,540,001 B1
(45) Date of Patent: Apr. 1, 2003

(54) METHOD OF HANDLING LAMINA OBJECTS

(75) Inventor: Martin McNestry, Heanor (GB)

(73) Assignee: Markem Technologies Limited, Nottingham (GB)

( * ) Notice: Subject to any disclaimer, the term of this patent is extended or adjusted under 35 U.S.C. 154(b) by 0 days.

(21) Appl. No.: 09/641,995

(22) Filed: Aug. 18, 2000

(30) Foreign Application Priority Data

Aug. 20, 1999 (GB) ..... 9919671

(51) Int. Cl.[7] ..... B44C 1/00; B25B 11/00

(52) U.S. Cl. ..... 156/541; 156/542; 156/DIG. 33; 269/21; 271/195

(58) Field of Search ..... 156/541, 542, 156/DIG. 33, DIG. 25, DIG. 28, DIG. 31; 269/21; 248/363; 271/211, 195; 406/86, 87, 88, 89, 84

(56) References Cited

U.S. PATENT DOCUMENTS

| | | | | |
|---|---|---|---|---|
| 3,645,832 A | | 2/1972 | Sauer | 156/541 |
| 3,717,381 A | * | 2/1973 | Hagler | 406/84 |
| 3,975,057 A | * | 8/1976 | Hurd | 302/31 |
| 4,081,201 A | * | 3/1978 | Hassan et al. | 406/88 |
| 4,124,429 A | * | 11/1978 | Crankshaw | 156/364 |
| 4,165,132 A | * | 8/1979 | Hassan et al. | 42/136 |
| 4,255,220 A | | 3/1981 | Kucheck et al. | |
| 4,556,443 A | | 12/1985 | Moya | |
| 5,470,420 A | * | 11/1995 | Yokajty | 156/566 |
| 5,853,530 A | | 12/1998 | Allen | 156/541 |

FOREIGN PATENT DOCUMENTS

| | | | |
|---|---|---|---|
| EP | 0 584 021 A1 | 2/1994 | 9/18 |
| GB | 2 078 668 A | 1/1982 | |
| GB | 2 320 004 A | 6/1998 | |

* cited by examiner

*Primary Examiner*—Michael W. Ball
*Assistant Examiner*—John L. Goff
(74) *Attorney, Agent, or Firm*—Fish & Richardson P.C.

(57) ABSTRACT

A method of handling a lamina object including feeding the lamina object on to surface of a handling member, the surface of the handling member including a plurality of first openings connectable to a vacuum source sufficient to attract the object to the member, and a plurality of second openings connectable to a source of pressurized gas, the method including applying suction to the first and simultaneously applying pressurized gas to the second openings, the suction and pressurized gas being controlled to lift the object out of direct contact with the surface of the handling member whilst retaining the object close to the surface, and applying a directed jet of pressurized gas to move the object relative to the handling member across the surface of the handling member.

26 Claims, 1 Drawing Sheet

METHOD OF HANDLING LAMINA OBJECTS

RELATED APPLICATIONS

This application claims priority to United Kingdom Application No. 9919671.9 filed Aug. 20, 1999 and assigned to Markem Technologies Ltd., the entire contents of which is incorporated herein by reference.

BACKGROUND OF THE INVENTION

This invention relates to a method of handling a lamina object. More particularly but not exclusively the method relates to a method of handling a label, e.g. for conveying a self adhesive label when removed from a backing web to which the label was releasably adhered, to a position from where the label may be applied to an article.

DESCRIPTION OF THE PRIOR ART

Apparatus are known for applying labels to articles using a blast of air applied through small holes in an applicator plate. The labels are held in contact with the plate by suction, which suction is overcome by or released while, the blast of air is applied.

From for example, U.S. Pat. No. 4,255,220 it is known to move such applicator plate to convey a label on the applicator plate from a position where the label is removed from a backing web, to a position where the label is applied by a blast of air. In common with other known similar arrangements, this therefore requires a drive and transmission means to move the applicator plate under the control of a control means which must also synchronise the application of a blast of air to remove the label from the applicator plate for application to an article, at an appropriate time.

SUMMARY OF THE INVENTION

According to one aspect of the invention we provide a method of handling a lamina object including feeding the lamina object on to surface of a handling member, the surface of the handling member including a plurality of first openings connectable to a vacuum source sufficient to attract the object to the member, and a plurality of second openings connectable to a source of pressurized gas, the method including applying suction to the first openings and simultaneously applying pressurized gas to the second openings, the suction and pressurized gas being controlled to lift the object out of direct contact with the surface of the handling member whilst retaining the object close to the surface, and applying a directed jet of pressurized gas to move the object relative to the handling member across the surface of the handling member.

Thus utilising the present invention, a lamina object such as a label may be conveyed without moving the label handling member.

In a preferred arrangement, the first openings in the surface of the handling member are arranged in a matrix which extends over substantially the entire surface of the handling member. The matrix may include a plurality of rows and columns. The second openings may too be arranged in a matrix over the surface of the handling member, the second openings being provided in lands between the first openings.

The first openings may all be connected to a common plenum so that the method includes providing a substantially constant vacuum over the surface of the handling member.

The second openings may be arranged in groups, each group being connected to a plenum which provides pressurized gas to the second openings of that group only. Preferably the second openings of the group are arranged in a zone of the surface of the handling member, and the method may include applying a greater gas pressure to the second openings of one group at an instant, compared to another group.

The method may include applying pressurized gas to the second openings of one group in one zone only prior to or subsequent to moving the object over the surface of the handling member so that the object may be retained in the zone to which gas pressure is applied or is not applied.

Thus where the handling member dimensions are sufficient for a plurality of objects to be fed on to the surface of the handling member, the plurality of objects may independently simultaneously be handled in different zones.

Where there are a plurality of zones arranged in a conveying direction, it has been found that by not applying pressurized gas to one of the zones, an object may be conveyed across the surface of the handling member by the directed jet, to a position where the zone to which the pressurized gas is applied meets an adjacent zone where only suction is applied, and may be held substantially stationary in that position until pressurized gas is applied to the second openings of the adjacent zone, or alternatively the object may be held substantially stationary within a zone, by temporarily discontinuing to supply pressurized gas to at least that zone.

Where there are a plurality of zones arranged laterally of a conveying direction, a corresponding plurality of objects may be moved across the surface of the receiving member substantially simultaneously and independently.

Although the surface of the handling member may be generally horizontal, the invention may be practiced where the surface is inclined to the horizontal or is even upside down. Where the surface is substantially upright, the method may include directing jets of pressurized gas in a direction to counter the effects of gravity. Alternatively, the method may include providing a runner along the bottom edge of the surface of the receiving member to prevent gravitational force acting on the object to cause the object to fall from the surface.

In a preferred embodiment a plurality of the second openings may each provide a directed jet to direct the object across the surface of the handling member although one or more directive jets may be provided which are not provided in the handling surface, if desired.

The method may include controlling the flow of pressurized gas to the second openings of the zones so that pressurized gas at a first pressure is fed to one zone and pressurized gas at a second pressure is fed to another zone in such manner that the orientation of the object on the surface of the handling ember may be changed in a controlled manner. For example in the case of a label, the label may be dispensed onto the surface of the handling member in one orientation, and rotated as the label moves across the surface of the handling member, so that the label may subsequently be applied to an article in an alternative orientation different from its orientation as the label was dispensed on to the surface of the handling member.

The invention is particularly useful for handling a self adhesive label or labels, in which case the method may include removing the label from a backing web prior to feeding the label on to the surface of the handling member. Such removal may be achieved using a peel bar for example.

The method may further include applying the label to an article which is moving relative to the handling member.

This may be achieved by directing the label from the surface of the handling member and wiping or rolling the label onto the relatively moving article.

According to a second aspect of the invention we provide an apparatus for performing the method of the first aspect of the invention, the apparatus including a handling member having a surface including a plurality of first openings connected in use to a vacuum source sufficient to attract the object to the member, and a plurality of second openings connected in use to a source of pressurized gas so that suction and pressurized gas are simultaneously applied to the surface of the handling member, means to control the suction and pressurized gas to lift the object out of direct contact with the surface of the handling member whilst retaining the object close to the surface, and there being means to apply a directed jet of pressurized gas to move the object relative to the handling member across the surface of the handling member.

Typically the label is lifted from the surface of the handling member only a very small amount, e.g. less then 0.5 mm. Thus as the label moves, there is the possibility of a part of the label coming into contact with the surface.

Thus the surface of the handling member may be a lubricated surface to aid label movement over the surface. For example the surface may be coated with or even made from a dry lubricant such as polytetrafluoroethylene.

The cross sections of at least some of the second openings may locally be enlarged at the surface of the handling member, and may include a flow passage which is inclined relative to surface, thus to provide directed jets.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
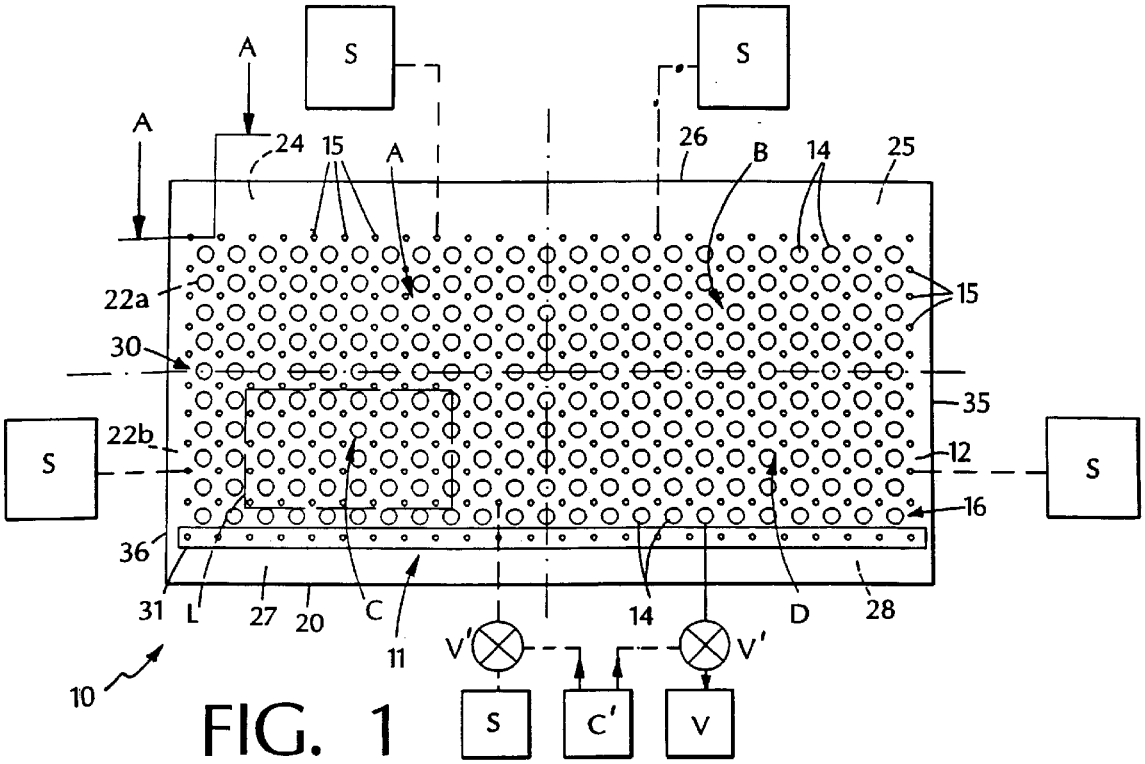
FIG. 1 is a plan view of a surface of a handling member for use in the method of the invention.

Referring to the drawings there is shown an apparatus 10 for handling lamina objects according to the method of the invention. The apparatus 10 to be described is for handling lamina objects being labels although it will be appreciated that the apparatus 10 may be used to handle other lamina objects such as for examples only, sheets of paper or cardboard e.g. in a manufacturing and/or packaging facility.

The apparatus 10 includes a label handling member 11 with a surface 12 which in this example is substantially planar, but could be curved by an amount depending upon the dimensions and flexibility of the labels to be handled. In FIG. 1, a label L is shown on the surface 12.

The surface 12 may be made of metal or the like and coated with a dry lubricants such as Polytetrafluoroethylene, or another dry lubricant, but preferably the surface 12 is made from a lubricant type material such as an Acetalhomopolymer such as is sold under the trade name Delrin. The surface 12 is fabricated with a plurality of openings provided therein.

Some of a set of first openings are indicated at 14. These are arranged in a matrix of columns and rows and the matrix substantially covers the surface 12. Some of a set of second openings are indicated at 15. The openings 15 of the second set are substantially smaller than the openings 14 of the first set. The second openings 15 are arranged in a matrix too, with the second openings 15 provided in lands between the first openings 14.

In this example, the first openings 14 are circular in cross section and have a nominal diameter of 5 mm at the surface 12. The second openings 15 are of circular cross section too, but have a nominal diameter typically of 0.2 mm but typically in the range 0.1 mm to 0.5 mm. Immediately adjacent the surface 12 though, the second openings 15 are enlarged as indicated at 18 in FIG. 4, and furthermore, the second openings 15 extend into the surface 12 and are provided by flow passages inclined at an angle to the surface 12 for a reason hereinafter explained.

The first, larger, openings 14 extend through the thickness of the member 11 and open to a common plenum 19 which is connected to a source of vacuum V. Thus in use, suction is applied to each of the first openings 14 at the surface 12, of sufficient magnitude to attract a label to the surface.

In use, the surface 12 may be inclined to the horizontal by up to 90° or may even be upside down. Where the member 12 is generally upright to prevent gravitational forces causing a label to fall from a lower side 20 of the member 11, either a simple runner may be provided along the lower side 20 below a lowermost row 16 of first openings 14, or else directed jets of air may be provided to counteract the effect of gravity, again as hereinafter described.

Figure 2:
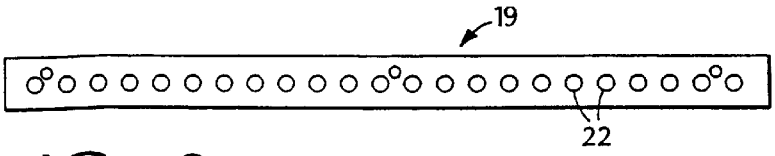
FIG. 2 is a side view of the surface of FIG. 1.
Figure 3:
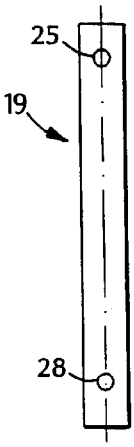
FIG. 3 is an end view of the surface of FIG. 1.
Figure 4:
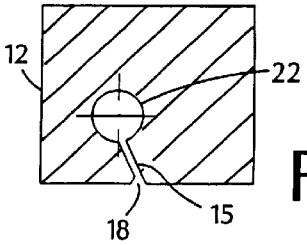
FIG. 4 is an enlarged fragmentary section through a part of the surface of FIG. 1.

The second, smaller, openings 15 do not extend throughout the thickness of the member 11. Rather, in the thickness of the member 11 there are provided a plurality of passages as indicated in FIGS. 2 and 4 at 22. Each passage 22 corresponds to one column of second openings 15, and each of the second openings 15 of a column, communicates with an associated passage 22. Along the length of the member 11, at either side of the surface 12, there are provided plenums, there being a pair of axially aligned plenums 24, 25 parallel to a top side 26 of tile member 10, and a pair of axially aligned plenums 27, 28 along the lower side 20 of the member 10. The plenums 24, 25 and 27, 28 are all isolated from each other, and furthermore, each of the passages 22 has a first upper part 22*a*, and a second lower part 22*b*, the upper 22*a* and lower 22*b* parts being isolated from one another at a position indicated by the arrow 30.

Thus the surface 12 of the handling member 11 has four zones indicated at A, B, C and D, each zone including a group of second openings 15, in this example the two zones indicated at A and B being arranged sequentially along the length of the surface 11, as are the two zones C and D, but with zones A and B, being parallel to zones C and D.

The plenums 24, 25 and 27, 28 are all connected to respective sources S of pressurized air or other gas. For example, a common source S of pressurized air may be connected to each of the plenums 24, 25 and 27, 28 via respective valves (not shown), so that pressurized air may be fed individually or simultaneously to one or more of the groups of second openings 15 from the plenum 24, 25, 27 and 28 under the control of a control means, or each plenum 24–28 may be connected to its own pressure source S.

Other zones arrangements may be utilized, or all of the second openings 15 may only be supplied simultaneously with pressurized air, as required. However a zoned arrangement is preferred for the reasons set out below.

Where the apparatus 10 relies upon jets or directed air to counteract the effects of gravity, such jets may be provided by a third set of openings 31 provided alongside the lowermost row 16 of first openings 14. The third openings 31 may simply be a lowermost row of second openings 15 as indicated, but with the openings 15 inclined to the surface 12 such as to direct jets of air generally upwardly, or the third openings 31 may be connected to another separate, perhaps greater pressure source of air as desired.

Otherwise the second openings 15 are inclined to the surface 12, e.g. typically at about 30° to direct jets of pressurized air from the second openings 15 towards an edge 35 of the member 11.

Use of the apparatus 10 will now be described.

A self adhesive label L provided on a backing web, may be removed from the backing web by a peel bar as is well known in the art, and dispensed or fed onto the handling member 11 e.g. at an edge 36 thereof but could if desired by fed onto the surface 12 at an upper edge 26 or even the lower edge 20. The suction applied to the first openings 14 will attract the label L to the surface 12 and thus such suction, combined with the effect of the upwardly directed jets from the third openings 31 where provided, or the runner along the lower edge of the surface 12, will retain the label. However pressurized air fed to the first openings 15 will counter the suction of the first openings 14 to the extent that the label L will be lifted off the surface 12 by a very small amount of typically a fraction of a millimetre. To achieve this, careful control of the suction and pressurized air is required. By virtue of the plenum 19 with which all of the first opening 14 communicate however, a generally constant suction force will be applied over the entire surface 12 of the handling member 11, and by the use of valves to control the flow of pressurized air to the respective plenums 25, 28, close control over the pressurized air can be achieved.

By virtue of the second openings 15, or at least some of the second openings 15 being inclined towards to opposite edge 35 of the surface 12, because the label L is out of direct contact with the surface 12, the label will move across the surface 12 of the member 11 from left to right as seen in FIG. 1 of the drawings. If the label is fed onto the surface 12 at edge 26, the label will migrate downwardly under gravity until either in contact with the runner 31, or influenced by the upwardly directed jets, and will move towards edge 35. Thus a label L may be conveyed from the dispenser at or adjacent edge 36 or edge 26, to the edge 35 of the surface 12, without requiring any moving parts to carry the label. The label will float across the surface 12 on a cushion of air, whilst being constrained by the suction applied by the first openings 14, and the air jets of the third openings 31 where provided, or the runner, close to the surface 12.

By positioning the edge 35 immediately adjacent a path for moving articles, a label L thus conveyed may be applied directly to an article, e.g. with the aid of a brush, roller or the like, to wipe or roll the label onto the article.

By virtue of the zoned arrangement of second openings 15, the label movement across the surface 12 may be more finely controlled. For example, by applying pressurized air to the second openings 15 in the zone A, or zones A and C, a label fed onto the surface 12 at edge 36 may be conveyed across the surface 12 towards the zone B or zones B and D. However, if no pressurized air is applied to the second openings 15, of the zones B and D, the label will not move across those zones, but as a consequence will be retained in a position immediately adjacent to the zone B or zones B and D.

Alternatively, label movement may be arrested in a zone A, B, C, or D by discontinuing to apply pressurized air to the second openings 15 in at least that zone.

Thus for example, a label L may be retained in a desired position until a signal is received from a remote sensing means that an article is approaching edge 35 of the surface 12. Thus label movement to the edge 35 may be coordinated with the article arrival adjacent the edge 35 so that the label may be applied to the article.

Retaining a label e.g. in a position in zone A adjacent zone B, or in zone B, also means that where a label is printed as it is dispensed onto the surface at edge 36 thereof, it is possible to commence printing of the next label to be applied. As the rate at which labels may be applied is in such an arrangement, limited by the speed at which labels can be printed, it is therefore possible considerably to increase the label applying rate as it is not necessary for a label to be applied to an article before commencing printing of the next label.

Because in the example described, the apparatus 10 has two parallel pairs of zones, i.e. zones A and B. and zones C and D, it is possible to use the apparatus 10 to handle a pair of labels simultaneously. Thus for example, a pair of labels may be retained in positions adjacent zones B and D respectively to await the arrival of articles at edge 35 to which the labels are to be applied. Each of the pair of labels may be conveyed to the edge 35 and applied to an article or articles individually, by opening an appropriate air valve to apply pressurized air to one of the zones B and D when required. Of course because the surface 12 is generally upright, a label conveyed across zone B to the edge 35 will be applied at a different (higher up) position on an article to a label conveyed across zone D to the edge which will be applied at a lower down position. Label position is not critical in some applications.

A single printer may be used to print across a pair of labels on the backing web, or a pair of printers may be provided, one for each label thus increasing tie rate of label availability for application still further.

As mentioned above other zone arrangements may be adopted. Thus the surface 12 may be long enough to have three zones between the edges 36, 35 and so two labels may be retained in individual zones, whilst a third is printed, although this would require close coordination in making zones active and inactive by opening/closing valves to admit pressurized air to the passages 22 feeding the second opening/closings 15 of the zones, or to stop the flow or pressurized air to one or more of the zones.

Possibly by suitably arranging the angles of the pressurized air jets from the second openings 15, the orientation of a label as the label moves across the surface, may be changed. More practically though, a rectangular label fed onto the surface at edge 36 longitudinally, may be rotated e.g. about 90° as it moves across the surface 12 by applying differential air jet pressures. For example, if the air pressure fed to the second openings 15 in zones A and B is made greater than the air pressure fed to the second openings 15 in zones C and D, a label moving from edge 36 to edge 35 will experience forces which will tend to rotate the label. Thus a label may be applied from edge 35 onto an article in a different orientation to that in which the label was fed onto the surface 12.

Alternatively, or additionally such a change in label orientation may be achieved by sequentially supplying greater pressure air to the columns and/or rows of second openings 15, although this may require that individual columns/rows or groups of the se may need to be isolated and the supply of pressurized air thereto individually controlled.

Various modifications may be made without departing from the scope of the invention. For example, although an arrangement which uses plenums 24, 25 and 27, 28 to supply pressurized air to passages 22 with which the second openings 15 communicate is a preferred way in which to provide pressurized air to the second openings 15, or to second openings 15 of one or more zones, other arrangements are possible. For example the second openings 15 may each communicate directly with one or more common plenums, e.g. provided in the width of the member 11 and through which plenum or plenums conduits which extend to the first openings 14, may extend.

Although as described, the surface 12 across which the labels are moved is generally rectangular, other configurations may be provided. Although in the example described, a label is conveyed generally linearly across the surface 12, albeit with a change of orientation where required, the label may be conveyed in a non-linear path by suitably angling the second openings 15.

As described above, the vacuum source V, pressure source S and associated control valves v' may be controlled by a control means C'.

What is claimed is:

1. A method of handling a lamina object including feeding the lamina object on to the surface of a handling member, the surface of the handling member including a plurality of first openings connectable to a vacuum source sufficient to attract the object to the member, and a plurality of second openings connectable to a source of pressurized gas, the method including applying suction to the first openings and simultaneously applying pressurized gas to the second openings, the suction and pressurized gas being controlled to lift the object out of direct contact with the surface of the handling member whilst retaining the object close to the surface, and applying a directed jet of pressurized gas to move the object relative to the handling member across the surface of the handling member, wherein the method is applied for handling a label or labels, the method including removing the label from a backing web prior to feeding the label on to the surface of the handling member.

2. A method according to claim 1 wherein the first openings in the surface of the handling member are arranged in a matrix which extends over substantially the entire surface of the handling member.

3. A method according to claim 2 wherein the matrix includes a plurality of rows and columns.

4. A method according to claim 1 wherein the second openings are arranged in a matrix over the surface of the handling member.

5. A method according to claim 4 where the first openings are arranged in a matrix wherein the second openings are provided in lands between the first openings.

6. A method according to claim 1 wherein the first openings are all connected to a common plenum and the method includes providing a substantially constant vacuum over the surface of the handling member.

7. A method according to claim 1 wherein the second openings are arranged in groups, each group being connected to a plenum which provides pressurized gas to the second openings of that group only.

8. A method according to claim 7 wherein the second openings of the group are arranged in a zone of the surface of the handling member, and the method includes applying a greater gas pressure to the second openings of one group at an instant, compared to another group.

9. A method according to claim 8 wherein the method includes applying pressurized gas to the second openings of one group in one zone only prior to or subsequent to moving the object over the surface of the handling member so that the object is retained in the zone to which gas pressure is applied or is not applied.

10. A method according to claim 9 wherein the handling member dimensions are sufficient for a plurality of objects to be fed on to the surface of the handling member, and the method includes independently simultaneously handling a plurality of objects in different zones.

11. A method according to claim 10 wherein there are a plurality of zones arranged in the conveying direction, and the method includes not applying pressurized gas to one of the zones, conveying an object across the surface of the handling member by the directed jet, to a position where the zone to which the pressurized gas is applied meets an adjacent zone where only suction is applied, and holding the object substantially stationary in that position until pressurized gas is applied to the second openings of the adjacent zone.

12. A method according to claim 10 wherein the method includes holding the object stationary within a zone, by temporarily discontinuing to supply pressurized gas to at least that zone.

13. A method according to claim 1 wherein there are a plurality of zones arranged laterally of a conveying direction, and the method includes moving a corresponding plurality of objects across the surface of the receiving member substantially simultaneously and independently.

14. A method according to claim 1 wherein a plurality of the second openings each provide a directed jet to direct the object across the surface of the handling member.

15. A method according to claim 1 wherein the method includes controlling the flow of pressurized gas to the second openings of the zones so that pressurized gas at a first pressure is fed to one zone and pressurized gas at a second pressure is fed to another zone in such manner that the orientation of the object on the surface of the handling member may be changed in a controlled manner.

16. A method according to claim 15 wherein the object is dispensed onto the surface of the handling member in one orientation, and is rotated as the object moves across the surface of the handling member.

17. A method according to claim 1 wherein the surface of the handling member is inclined to the horizontal by up to 90°.

18. A method according to claim 17 wherein the method includes directing jets of pressurised gas in a direction to counter the effects of gravity.

19. A method according to claim 18 wherein the method includes providing a runner along a bottom edge of the surface of the receiving member.

20. A method of handling a lamina object including feeding the lamina object on to the surface of a handling member, the surface of the handling member including a plurality of first openings connectable to a vacuum source sufficient to attract the object to the member, and a plurality of second openings connectable to a source of pressurized gas, the method including applying suction to the first openings and simultaneously applying pressurized gas to the second openings, the suction and pressurized gas being controlled to lift the object out of direct contact with the surface of the handling member whilst retaining the object close to the surface, and applying a directed jet of pressurized gas to move the object relative to the handling member across the surface of the handling member, wherein the method is applied for handling a self adhesive label or labels, the method including removing the label from a backing web prior to feeding the label on to the surface of the handling member.

21. A method according to claim 20 wherein the further method includes applying the label to an article which is moving relative to the handling member.

22. A method according to claim 21 wherein the label is directed from the surface of the handling member and wiped or rolled onto the relatively moving article.

23. An apparatus for performing the method of handling a label including feeding the label on to a surface of a handling member, the surface of the handling member including a plurality of first openings connectable to a vacuum source sufficient to attract the label to the member, and a plurality of second openings connectable to a source of pressurized gas, and wherein a control means is provided to control the suction and pressurized gas to lift the label out of direct contact with the surface of the handling member whilst retaining the label close to the surface, and there being means to apply a directed jet of pressurized gas to move the label relative to the handling member across the surface of the handling member.

24. An apparatus according to claim 23 wherein the surface of the handling member is a lubricated surface.

25. An apparatus according to claim 24 wherein the surface is coated with or made from a dry lubricant.

26. An apparatus according to claim 24 wherein the cross sections of at least some of second openings are locally enlarged at the surface of the handling member, and include a flow passage which is inclined relative to surface, thus to provide directed jets.

* * * * *